US007479260B2

(12) United States Patent
Lin et al.

(10) Patent No.: US 7,479,260 B2
(45) Date of Patent: Jan. 20, 2009

(54) RECYCLING FACILITY FOR TNT MATERIALS

(75) Inventors: Zui Yeh Lin, Taipei (TW); Tzu Lung Ho, Taipei (TW); Wei Shuo Lo, Taipei (TW); Wan Kuei Yao, Taipei (TW); Yung Ho Chiu, Taipei (TW); Ching Hsien Liu, Taipei (TW); Yu Jen Lin, Taipei (TW)

(73) Assignee: Taiwan Supercritical Technology Co., Ltd., Jhongshan District, Taipei (TW)

( * ) Notice: Subject to any disclaimer, the term of this patent is extended or adjusted under 35 U.S.C. 154(b) by 644 days.

(21) Appl. No.: 11/258,446

(22) Filed: Oct. 25, 2005

(65) Prior Publication Data

US 2007/0110641 A1 May 17, 2007

(51) Int. Cl.

| | |
|---|---|
| ***B01J 19/00*** | (2006.01) |
| ***A61L 2/00*** | (2006.01) |
| ***C07F 1/00*** | (2006.01) |
| ***C06B 21/00*** | (2006.01) |

(52) U.S. Cl. ..... 422/198; 422/129; 422/224; 422/261; 422/267; 422/292; 588/900; 435/262; 435/290.1

(58) Field of Classification Search ..... 422/198, 422/129, 224, 261, 267, 292; 588/200, 202, 588/203, 205, 900; 435/262, 290.1; 568/935
See application file for complete search history.

(56) References Cited

U.S. PATENT DOCUMENTS

| | | | | |
|---|---|---|---|---|
| 5,540,846 | A * | 7/1996 | Koch et al. | 210/741 |
| 5,907,818 | A * | 5/1999 | Hebisch et al. | 588/320 |
| 5,998,691 | A * | 12/1999 | Abel et al. | 588/318 |
| 2003/0175942 | A1 * | 9/2003 | Kim et al. | 435/262 |

* cited by examiner

*Primary Examiner*—Walter D Griffin
*Assistant Examiner*—Huy-Tram Nguyen
(74) *Attorney, Agent, or Firm*—Charles E. Baxley

(57) ABSTRACT

A recycling facility includes a receptacle for receiving the ammunition to be cleaned, a gas tank for receiving a pressurized gas and coupled to the receptacle, for supplying the pressurized gas to the receptacle, and a heater coupled between the gas tank and the receptacle, for preheating the pressurized gas before the pressurized gas flowing into the receptacle, and for melting and removing the TNT material from the ammunition. The receptacle includes a control valve coupled between the heater and the receptacle, and a control valve coupled between the heater and the gas tank. A collecting casing may be coupled to the receptacle, and coupled to the gas tank via a filter.

9 Claims, 1 Drawing Sheet

RECYCLING FACILITY FOR TNT MATERIALS

BACKGROUND OF THE INVENTION

1. Field of the Invention

The present invention relates to a recycling facility, and more particularly to a pressurized recycling facility for using various pressurized air or gas to clean and to remove and to collect and to recycle TNT (trinitrotoluene) materials from various ammunition, such as bullets, bombs, etc., and to allow the recycle TNT (trinitrotoluene) materials to be reused.

2. Description of the Prior Art

Typical ammunition, such as bullets, bombs, etc. may comprise various TNT (trinitrotoluene) materials therein which is explosive and dangerous, and which should be carefully treated when the typical ammunition is useless or is going to be discarded or to be thrown away.

Normally, when the typical ammunition is useless and is going to be discarded or to be thrown away, the typical ammunition will be dismantled to have the metal outer shells to be recycled or reused. However, it takes a large amount of manpower to dismantle the typical ammunition, and highly specialized or skilled persons are required to dismantle the typical ammunition. In addition, the TNT (trinitrotoluene) materials contained therein are normally discarded and wasted, and may not be suitably recycled or reused again.

For reducing the cost and time to dismantle the typical ammunition, most of the typical ammunition will be exploded. However, the explosion of the typical ammunition will seriously pollute our environment.

The present invention has arisen to mitigate and/or obviate the afore-described disadvantages of the conventional treatments for the useless ammunition to be discarded or to be thrown away.

SUMMARY OF THE INVENTION

The primary objective of the present invention is to provide a pressurized recycling facility for using various pressurized air or gas to clean and to remove and to collect and to recycle TNT (trinitrotoluene) materials from various ammunition, such as bullets, bombs, etc., and to allow the recycle TNT (trinitrotoluene) materials to be reused.

The other objective of the present invention is to provide a pressurized recycling facility for recycling the TNT materials from various ammunition with pressurized air or gas, such as $CO_2$, that is highly spreadable, and that will not pollute our environment, and that may be recycled and used again and again.

In accordance with one aspect of the invention, there is provided a recycling facility for recycling a TNT material from an ammunition, the recycling facility comprising a receptacle for receiving the ammunition to be cleaned, a gas tank for receiving a pressurized gas, and coupled to the receptacle, for supplying the pressurized gas to the receptacle, and a heater coupled between the gas tank and the receptacle, for preheating the pressurized gas before the pressurized gas flowing into the receptacle, and for melting and removing the TNT material from the ammunition.

The receptacle includes a control valve provided and coupled thereto, and coupled between the heater and the receptacle, and a further control valve coupled between the heater and the gas tank.

A collecting casing may further be provided and coupled to the receptacle, for receiving and collecting the TNT material. The gas tank includes a filter coupled thereto, and coupled between the gas tank and the casing, for filtering and separating the TNT material from the pressurized gas, and for allowing the pressurized gas to be filtered and recycled into the gas tank.

A bottle may further be provided for receiving and storing the pressurized gas, coupled to the gas tank, for supplying the pressurized gas to the gas tank. The gas tank includes a cooler coupled thereto, and coupled between the gas tank and the bottle, for cooling the pressurized gas before flowing into the gas tank.

A supersonic container may further be provided and coupled to the gas tank for receiving the ammunition and for removing the TNT material from the ammunition with supersonic waves, and for allowing the pressurized gas to flow from the gas tank into the container and to spray and to remove the TNT material from the ammunition. The container is coupled to the receptacle with a tubing.

A housing may further be provided and coupled to the gas tank for receiving the ammunition, and for allowing the pressurized gas to flow from the gas tank into the housing and to spray and to remove the TNT material from the ammunition. The housing may also be coupled to the receptacle with the tubing.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
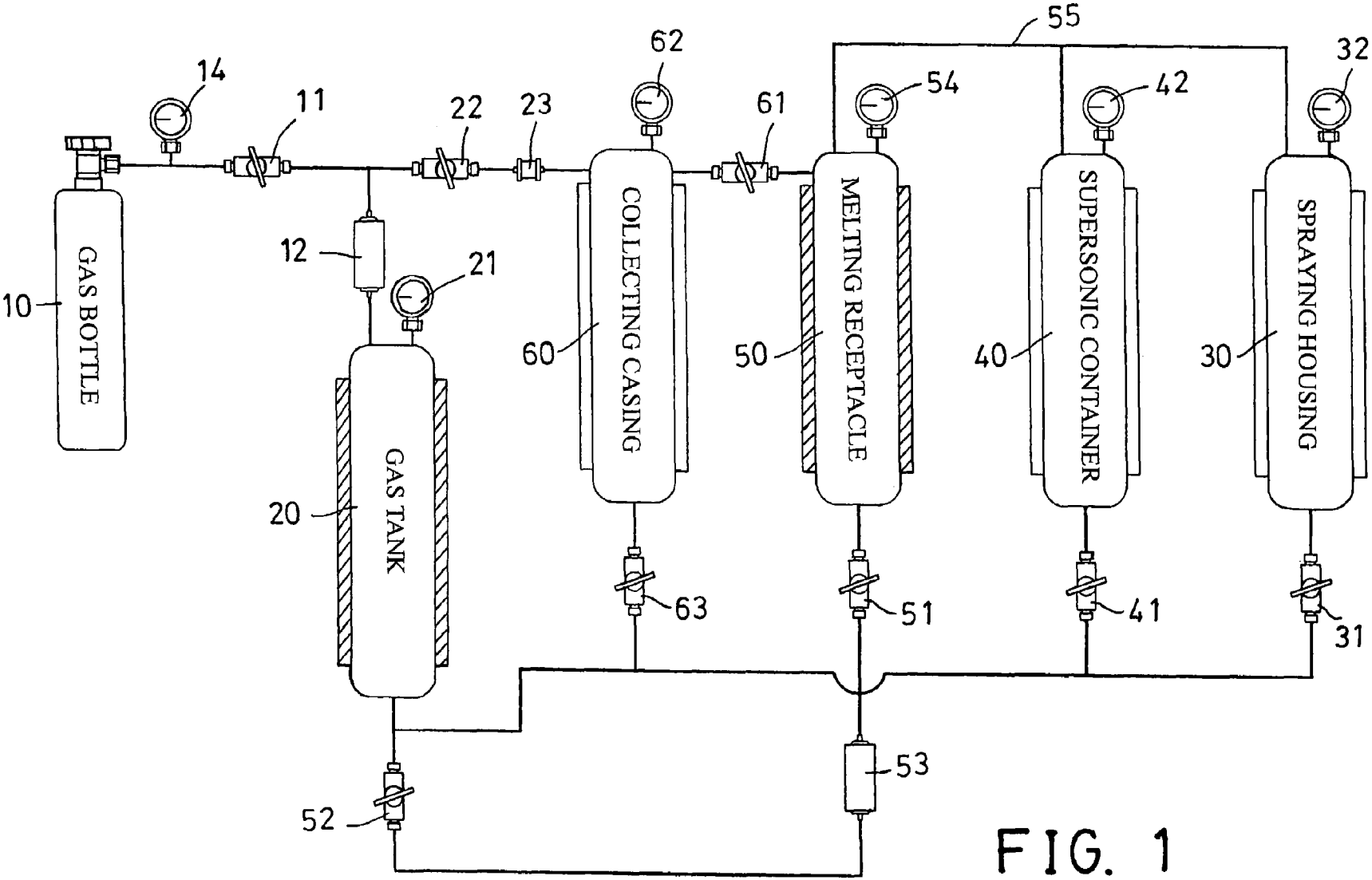
FIG. 1 is a plan and partial cross sectional view of a pressurized recycling facility in accordance with the present invention.

Referring to FIG. 1, a pressurized recycling facility in accordance with the present invention comprises a bottle 10, such as a gas or carbon dioxide $CO_2$ bottle 10 for receiving and storing pressurized gas or $CO_2$, which is highly spreadable and which is not sticky, and a gas tank 20 coupled to the bottle 10, for receiving the pressurized gas or $CO_2$ therefrom. It is preferable that the pressurized fluid or $CO_2$ contained within the bottle 10 is in the pressure ranging from 0~80 kg/cm$^2$, and maintained at least greater than 50 kg/cm$^2$. A control valve 11 is coupled between the bottle 10 and the gas tank 20, for controlling the gas or $CO_2$ to flow from the bottle 10 to the gas tank 20.

A cooler 12 may further be provided and coupled between the bottle 10 or the control valve 11 and the gas tank 20, for suitably or slightly cooling the gas or $CO_2$ before flowing into the gas tank 20. A pressure gauge 14 may further be provided and attached or coupled to the bottle 10, such as coupled to the upper portion of the bottle 10, to detect the pressure within the bottle 10. Another pressure gauge 21 may further be provided and attached or coupled to the gas tank 20, such as attached to top of the gas tank 20, to detect the pressure within the gas tank 20. The gas tank 20 is workable in the pressure ranging from 10~150 kg/cm$^2$.

A spraying or working housing 30 is provided for receiving the objects or workpieces or the useless ammunition to be discarded or to be thrown away, that may comprise a number of apertures or holes or passages or perforations or gaps deeply formed therein, and that may not be easily washed or cleaned by conventional cleaning devices or water spraying methods or the like. The working housing 30 may include one or more doors or covers (not shown) for allowing the ammunition to be removed from or to be engaged into the working housing 30, and thus for allowing the ammunition to be cleaned within the working housing 30 by the pressurized fluid or gas or $CO_2$. The working housing 30 is workable in the pressure ranging from 5~10 kg/cm$^2$.

A control valve 31 is coupled between the gas tank 20 and the working housing 30, for controlling the pressurized gas or $CO_2$ to flow from the gas tank 20 to the working housing 30, and to spray onto the ammunition, and to wash or to remove the TNT materials from the ammunition. A further pressure gauge 32 may further be provided and attached or coupled to the working housing 30, such as attached to top of the working housing 30, to detect the pressure within the working housing 30. The control valve 31 may be closed to stop supplying the pressurized gas or $CO_2$ to the working housing 30 after the washing or spraying operation.

A supersonic container 40 is further provided for receiving the washed or sprayed ammunition which has been subjected with the washing or spraying operation in the working housing 30, and may also include one or more doors or covers (not shown) for allowing the ammunition to be removed from or to be engaged into the container 40, and thus for allowing the ammunition to be cleaned within the container 40 by the pressurized fluid or gas or $CO_2$. The container 40 is provided for further washing or cleaning the ammunition with such as supersonic wave or process in a frequency of about 28 KHz.

A further control valve 41 is coupled between the gas tank 20 and the container 40, for controlling the pressurized gas or $CO_2$ to flow from the gas tank 20 to the container 40, and to further spray onto the ammunition, and to further wash or remove the TNT materials from the ammunition. A further pressure gauge 42 may further be provided and attached or coupled to the container 40, such as attached to top of the container 40, to detect the pressure within the container 40. The control valve 41 may be closed to stop supplying the pressurized gas or $CO_2$ to the container 40 after the supersonic washing or spraying operation.

A melting receptacle 50 is further provided for receiving the washed or sprayed ammunition which has been subjected with the supersonic washing or spraying operation in the container 40, and may also include one or more doors or covers (not shown) for allowing the ammunition to be removed from or to be engaged into the receptacle 50, and thus for allowing the ammunition to be treated within the receptacle 50 by the pressurized fluid or gas or $CO_2$. The receptacle 50 is provided for melting the TNT materials that are still attached or stuck to the ammunition, and is preferably controlled and worked in a temperature ranging from 40~90° C., and workable in the pressure ranging from 100~500 kg/cm$^2$.

A control valve 51 is coupled between the gas tank 20 and the receptacle 50, for controlling the pressurized gas or $CO_2$ to flow from the gas tank 20 to the receptacle 50, and to further wash or remove the TNT materials from the ammunition. A further control valve 52 and a heater 53 may further be provided and attached or coupled to the control valve 51 and then to the receptacle 50, for controlling and preheating the pressurized gas or $CO_2$ to a greater temperature, for melting and removing the TNT materials from the ammunition. A further pressure gauge 54 may further be provided and attached or coupled to the receptacle 50, such as attached to top of the receptacle 50, to detect the pressure within the receptacle 50. The control valves 51, 52 may be closed to stop supplying the pressurized gas or $CO_2$ to the receptacle 50 after the melting operation.

A collecting casing 60 is further provided for receiving and collecting the TNT materials removed or separated or melted from the ammunition, and may be coupled to the receptacle 50 via a control valve 61, to allow the melted TNT materials to flow from the melting receptacle 50 to the collecting casing 60. A tubing 55 may further be provided and coupled between the working housing 30 and the container 40 and the receptacle 50, to allow the TNT materials washed or removed from the ammunition to flow from the working housing 30 and the container 40 to the receptacle 50, and then to the collecting casing 60. The collecting casing 60 is workable in the pressure ranging from 10~300 kg/cm$^2$.

A pressure gauge 62 may further be provided and attached or coupled to the collecting casing 60, such as attached to top of the collecting casing 60, to detect the pressure within the collecting casing 60. A control valve 22 and a filter 23, such as a 15 μm filter 23 may further be provided and coupled between the gas tank 20 and the collecting casing 60, such as coupled between the upper portions of the gas tank 20 and the collecting casing 60, for controlling and guiding the pressurized gas or $CO_2$ to flow from the collecting casing 60 back to the gas tank 20. The filter 23 may filter and remove the TNT materials from the pressurized gas or $CO_2$, to allow the TNT materials to be collected within the collecting casing 60, and to allow the filtered pressurized gas or $CO_2$ to flow back and to be recycled into the gas tank 20.

Another control valve 63 is coupled between the gas tank 20 and the collecting casing 60, for controlling the pressurized gas or $CO_2$ to flow from the gas tank 20 to the collecting casing 60, and to force or to blow the TNT materials and the pressurized gas or $CO_2$, to flow through the control valve 22 and the filter 23, and thus to allow the TNT materials to be filtered by the filter 23, and to be collected within the collecting casing 60. The pressurized gas or $CO_2$, may thus be recycled and used again and again, and the TNT materials may thus be suitably filtered and collected within the collecting casing 60.

It is preferable that the pressurized gas or $CO_2$ is supplied into the collecting casing 60, to maintain the pressure within the collecting casing 60 above 10 kg/cm$^2$, and to allow the pressurized gas or $CO_2$ to flow back and to be recycled into the gas tank 20. When the pressure within the collecting casing 60 is lower than 10 kg/cm$^2$, for example, the control valve 63 may be opened to remove or to discharge or to collect the TNT materials from the collecting casing 60.

In operation, as shown in FIG. 1, the ammunition to be cleaned may be directly engaged into the receptacle 50 for allowing the TNT materials to be directly melted and removed from the ammunition. The ammunition may further be disposed into the working housing 30 and/or the container 40, for being subjected with additional washing or spraying operations, before being subjected with the melting operation, to allow a portion of the TNT materials to be removed or disengaged from the ammunition before the ammunition is subjected with the melting operation. It is to be noted that the pressurized fluid or gas, such as $CO_2$, will not pollute our environment, and may be recycled and used again and again. In addition, the TNT materials may be safely collected and recycled without being exploded.

Accordingly, the pressurized recycling facility in accordance with the present invention may thus be provided for using the pressurized air or gas to remove and to collect and to recycle TNT materials from various ammunition, such as bullets, bombs, etc., and to allow the recycle TNT materials to be reused, the pressurized air or gas may be selected from $CO_2$ that is highly spreadable, and that will not pollute our environment, and that may be recycled and used again and again.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. A recycling facility for recycling a TNT material from an ammunition, said recycling facility comprising:

a receptacle for receiving the ammunition to be cleaned, a gas tank for receiving a pressurized gas, and coupled to said receptacle, for supplying the pressurized gas to said receptacle, a heater coupled between said gas tank and said receptacle, for preheating the pressurized gas before the pressurized gas flowing into said receptacle, and for melting and removing the TNT material from the ammunition, and a housing coupled to said gas tank for receiving the ammunition, and for allowing the pressurized gas to flow from said gas tank into said housing and to spray and to remove the TNT material from the ammunition.

2. The recycling facility as claimed in claim 1, wherein said receptacle includes a control valve provided and coupled thereto, and coupled between said heater and said receptacle, and a further control valve coupled between said heater and said gas tank.

3. The recycling facility as claimed in claim 1 further comprising a collecting casing coupled to said receptacle, for receiving and collecting the TNT material.

4. The recycling facility as claimed in claim 1, wherein said housing is coupled to said receptacle with a tubing.

5. A recycling facility for recycling a TNT material from an ammunition, said recycling facility comprising:

a receptacle for receiving the ammunition to be cleaned, a gas tank for receiving a pressurized gas, and coupled to said receptacle, for supplying the pressurized gas to said receptacle, a heater coupled between said gas tank and said receptacle, for preheating the pressurized gas before the pressurized gas flowing into said receptacle, and for melting and removing the TNT material from the ammunition, and a collecting casing coupled to said receptacle, for receiving and collecting the TNT material, said gas tank including a filter coupled thereto, and coupled between said gas tank and said casing, for filtering and separating the TNT material from the pressurized gas, and for allowing the pressurized gas to be filtered and recycled into said gas tank.

6. A recycling facility for recycling a TNT material from an ammunition, said recycling facility comprising:

a receptacle for receiving the ammunition to be cleaned, a gas tank for receiving a pressurized gas, and coupled to said receptacle, for supplying the pressurized gas to said receptacle, a heater coupled between said gas tank and said receptacle, for preheating the pressurized gas before the pressurized gas flowing into said receptacle, and for melting and removing the TNT material from the ammunition, and a bottle for receiving and storing the pressurized gas, coupled to said gas tank, for supplying the pressurized gas to said gas tank.

7. The recycling facility as claimed in claim 6, wherein said gas tank includes a cooler coupled thereto, and coupled between said gas tank and said bottle, for cooling the pressurized gas before flowing into said gas tank.

8. A recycling facility for recycling a TNT material from an ammunition, said recycling facility comprising:

a receptacle for receiving the ammunition to be cleaned, a gas tank for receiving a pressurized gas, and coupled to said receptacle, for supplying the pressurized gas to said receptacle, a heater coupled between said gas tank and said receptacle, for preheating the pressurized gas before the pressurized gas flowing into said receptacle, and for melting and removing the TNT material from the ammunition, and a supersonic container coupled to said gas tank for receiving the ammunition and for removing the TNT material from the ammunition with supersonic waves, and for allowing the pressurized gas to flow from said gas tank into said container and to spray and to remove the TNT material from the ammunition.

9. The recycling facility as claimed in claim 8, wherein said container is coupled to said receptacle with a tubing.

* * * * *